United States Patent [19]

Smuda et al.

[11] Patent Number: 4,566,673

[45] Date of Patent: Jan. 28, 1986

[54] HYDRAULIC DEVICE FOR RERAILING VEHICLES

[75] Inventors: Siegfried Smuda, Erlangen; Peter Horner, Nuremberg; Karl Kögel, Erlangen; Peter Zeitler, Fürth, all of Fed. Rep. of Germany

[73] Assignee: FAG Kugelfischer Georg Schafer Kommdnditgesellschaft auf Aktien, Fed. Rep. of Germany

[21] Appl. No.: 651,444

[22] Filed: Sep. 17, 1984

Related U.S. Application Data

[63] Continuation-in-part of Ser. No. 528,084, Aug. 31, 1983, abandoned.

[30] Foreign Application Priority Data

Sep. 11, 1982 [DE] Fed. Rep. of Germany ..... 3233752

[51] Int. Cl.[4] ..... B66F 3/00

[52] U.S. Cl. ..... 254/84; 254/89 H

[58] Field of Search ..... 254/89 H, 93, 423, 84–85; 60/407, 412; 91/6, 32, 415, 165

[56] References Cited

U.S. PATENT DOCUMENTS

| | | | |
|---|---|---|---|
| 3,136,220 | 6/1964 | Kamm | 91/165 |
| 3,291,321 | 12/1966 | Hamilton | 91/165 |
| 3,347,135 | 10/1967 | Ahlbeck et al. | 91/165 |
| 3,687,008 | 8/1972 | Densmore | 91/165 |
| 4,273,027 | 6/1981 | Reinhard et al. | 91/6 |
| 4,291,612 | 9/1981 | Day | 91/6 |

FOREIGN PATENT DOCUMENTS 1098978 2/1961 Fed. Rep. of Germany .

1755022 11/1974 Fed. Rep. of Germany .

OTHER PUBLICATIONS

The Journal Verkehr und Tecknik 3 (1967), H. 3, S.58, 1.Sp., Abs. 2, Bild 1 auf S.57.

*Primary Examiner*—Robert C. Watson

*Attorney, Agent, or Firm*—Ostrolenk, Faber, Gerb & Soffen

[57] ABSTRACT

A vehicle rerailing device for use in difficult climates and the full range of temperature conditions present in such climates comprising rerailing elements connectable to and acting on a derailed and possibly overturned vehicle and hydraulic means which can be operated over said full range of temperature conditions to operate the rerailing elements. Said hydraulic means comprises a hydraulic lift device which includes a plurality of pressure displacement cylinders, each with a displaceable piston in it, a pressure chamber at one side of the piston and a second chamber at the other side of the piston. A high pressure generating unit is connected with the pressure chamber. A vacuum generator is connected with the pressure chamber. A control valve determines whether the pressure chamber is pressurized or is at reduced pressure to shift the piston, respectively, to lift the load or to return unloaded. To assist return of the unloaded piston, the chambers behind the pistons of at least some of the cylinders are pressurized at a lower pressure and permit return of the piston despite the condition of the hydraulic fluid induced by low temperature. The control valves are at a control table and the low pressure connections for return of the pistons are also at the table.

11 Claims, 3 Drawing Figures

HYDRAULIC DEVICE FOR RERAILING VEHICLES

This is a continuation-in-part of our application Ser. No. 528,084 filed Aug. 31, 1983 and now abandoned for Hydraulic Lift Device.

BACKGROUND OF THE INVENTION

The present invention relates to a hydraulic lift device, which is particularly useful for rerailing overturned rail vehicles.

The hydraulic lift device to which the present invention is directed comprises a plurality of hydraulic lift and/or displacement cylinders. A high pressure source communicates with the pressure chamber of each of the hydraulic lift cylinders for driving the piston therein to shift under load, thereby for providing the lift. A low pressure connection to the same pressure chamber feeds a vacuum generator, so that the pressure in the pressure chamber can be reduced to return the unloaded piston. Control valves determine which of the high pressure or low pressure connections is made to the pressure chamber. The operators for the control valves may be provided on a control table.

As noted above, it is contemplated that the hydraulic lift device of the invention be used for rerailing overturned rail vehicles and it is particularly adapted for this purpose. However, hydraulic lift devices are useful in other contexts, as well.

Such a hydraulic lift device has the advantage that for the lift cylinders, it requires only a single hydraulic line and a single three-way control valve which makes it possible to connect the one pressure chamber of the cylinder selectively to the high-pressure connection for lifting or to the vacuum generator, which is for instance a suction nozzle, for returning an unloaded piston. Such a rerailing device with a hydraulic lift device is known from German Federal Republic Pat. No. 1 098 978. Another important advantage is the possibility of particularly sensitive control, especially upon the starting of the lowering of the load. This is inherent because only a single control valve intended for single-acting work cylinders is provided. Devices of this kind are therefore in widespread use.

One disadvantage of these devices is that at temperatures below −20° C., the return motion of the pistons affer elimination of the load is slow, due to the relatively thick consistency of the hydraulic oil.

SUMMARY OF THE INVENTION

The object of the present invention is to provide a rerailing device of the above type which, at only slight additional expense and while retaining the possibility of sensitive operation, permits operation over a full range of temperature conditions down to very cold temperatures and comprises additional parts which can be added easily, and even subsequently, to existing devices.

To aid in the return of the unloaded piston of at least some of the hydraulic lift and displacement cylinders, a low pressure connection, at a pressure lower than the high pressure connection, is connected to the second chamber of the cylinder at the other side of the piston, and this low pressure in the second chamber cooperates with the reduced pressure in the pressure chamber to drive the unloaded piston to return. Typically, the low pressure supply to the second chamber is continuous, and it is low enough not to interfere with the high pressure in the pressure chamber needed to displace the piston under load. The connections from the low pressure generator to the second chambers of all of the displacement cylinders to be supplied by the low pressure generator are also provided at the same control table where the control valves are supported.

The hydraulic lift cylinders are not the double-acting working cylinders known for rerailing devices, but rather are single-acting cylinders whose pistons may be placed continuously under a return pressure of 20 to 50 bars, like a hydraulic spring, by connection of the second chamber above the piston to the low pressure supply. This low return pressure is negligible during the lifting process when the major pressure is applied to the pressure chamber. Nevertheless, this return pressure in the second chamber above the piston is extremely effective upon the return of the piston after the elimination of the load.

Since rerailing devices for restoring derailed railroad cars or other vehicles which have left the rails and perhaps overturned are known, only sufficient description of such devices are provided to set the environment and applicability of the present invention and such description of rerailing devices is shown in connection with diagrammatic representations thereof.

It was long ago discovered (see German Pat. No. 1 099 978) that in rerailing equipment, the use of double-action operating hydraulic cylinders requiring two hydraulic lines for each cylinder could be avoided. Since several operating cylinders must usually be employed, the operation was almost impossible to monitor because of the large number of hose lines required.

Therefore, an important step occurred when a method was discovered (see German Pat. No 1 098 978) in which only one hose per cylinder was required and the piston was returned by vacuum applied to the pressure connection.

One and the same, hydraulic hose could accordingly be used both to erect the vehicle or push in onto the rerailing bridge subject to high pressure and to retract the piston with relatively slight vacuum. As will readily be evident, only half of the previously necessary hose lines were accordingly necessary at the site.

It became apparent that in sites characterized by very low temperature, the piston could be retracted subject to vacuum only very slowly because the low temperature tended to stiffen the hydraulic oil. One substitute solution that offered itself was the use of double-action hydraulic cylinders. This meant, however, that it would be necessary to manufacture and warehouse two different types of rerailing equipment, one with vacuum piston return for warm climates and the other with double-action cylinders for arctic climates and the like. This would, of course, represent quite a considerable expense.

The present invention provides the means for obtaining the advantages of both methods without the drawbacks of either.

The point of departure of the present invention is the use of rerailing equipment in which the return stroke of the piston was accomplished by vacuum alone. The vacuum was generated in previous equipment not only by the high-pressure source for the operating stroke of the cylinder, but also by a low-pressure source that governs a suction nozzle for generating vacuum for the piston return stroke. In accordance with the present invention, a universal operation could be obtained in a very simple way if the second operating space of a cylinder could be connected through a simple additional line to the existing source of low pressure.

In applications where the ambient temperature was normal or when there was enough time available for the piston to return, the return stroke could be obtained as previously by applying vacuum to the pressure space. In this case, only the relatively few pressure-hose lines would be necessary. The same components, however, could be utilized during periods of very low outside temperature to obtain a rapid return stroke. It would only be necessary to extend an additional hose line from the low-pressure source to the second annular space in one and the same cylinder.

In addition to the return stroke generated by the vacuum applied to the pressure space, the piston is now subjected to a constantly active force in the return direction.

The system of the present invention accordingly does not involve a different cylinder drive but is a wholly new method of operation (suction on one side and pressure on the side of the piston). The low-pressure source can either be connected up by itself to return-stroke the piston or can be left connected during the whole operation because it hardly affects the load stroke of the cylinder.

Utilizing one and the same device for both purposes is a very considerable technical and economic advance. Equipment operating by the method in accordance with the invention is accordingly distinguished by very considerable serviceability. The invention also simplifies warehousing and reduces the cost thereof.

Thus, a series of separate modules that are individually known are controlled in a novel way for producing a new result.

Known rerailing equipment operates strictly with a vacuumized piston-return stroke or strictly with double-action cylinders producing the unexpected result described above. The novelty of the present result is also evident in that rerailing equipment of this type has existed now for more than 60 years with no one in the art arriving at the solution of the invention.

Other objects and features of the invention are described below with reference to an illustrative embodiment, which is shown in the accompanying drawings.

DETAILED DESCRIPTION OF THE PREFERRED EMBODIMENTS

Figure 1:
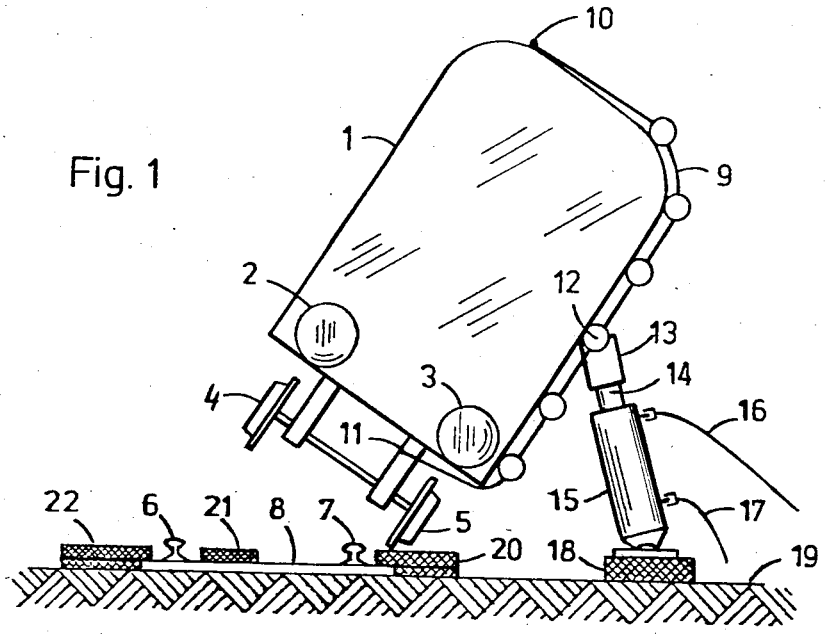
FIG. 1 shows a vehicle which is to be set upright, it being in approximately half-righted condition.

The vehicle 1 which is to be rerailed has the buffers 2 and 3, and wheels designated 4 and 5. It is to be restored to the rails 6 and 7 of the track which rails are secured to tier 8.

In FIG. 1, a lift strap 9 is fastened around the vehicle, the attachment being effected here at the areas 10 and 11 of the vehicle. The lift strap 9 has a preferred conformation similar to a rope ladder with the transverse rungs 12. The claw 13 grips from below around one of the transverse rungs 12. The claw is seated on the piston rod 14 of a lifting cylinder 15. Cylinder 15 is provided with hoses 16 and 17. The lifting cylinder 15 is in this connection pivotally mounted on a hardwood base support 18 which rests on the ground 19. Further, hardwood base supports 20, 21 and 22 are provided on the ground 19.

The interaction of the parts shown in FIG. 1 will now be briefly described. It is assumed in this case that the vehicle 1 initially is lying on the ground. A rerailing set generally includes, in standard design, both small and large lifting cylinders 15. The vehicle 1 is first lifted somewhat by one or two smaller cylinders 15 so that it assumes a slightly inclined position. As soon as the wheels 4 and 5, upon the further lifting, begin to approach the ground, they come to rest on the hardwood support bases 20 and 21, the wheel 5 doing so first. By selecting larger and larger lifting cylinders 15 in combination with the selection of corresponding transverse rungs 12, the vehicle is then brought, step by step, continuously further into the vertical position. The moment then arrives when the vehicle 1, with the wheel 5 on the hardwood base support 20, tilts into the vertical position in which the wheel 4 comes onto the hardwood base support 21. Thereupon by means of ordinary cylinders (not shown in the drawing) which are placed at given points of the vehicle 1 which are intended for his purpose, the vehicle 1 is lifted in vertical direction a sufficient distance so that special jacks 23 (FIG. 2) with piston rods 24 can be placed below one or both ends of the vehicle. The jacks 23 are arranged in this connection on a wheel truck 25 supported for appropriate movement on a rerailing bridge 26. The bridge extends over the rails 6 and 7 as well as further hardwood base supports 27 and 28. A displacement cylinder 29 is used for shifting or moving the wheel truck 25. This cylinder is fastened on the rerailing bridge 26 by a pin 30 which engages in corresponding openings in the top of said rerailing bridge. The displacement cylinder 20 is provided with the hoses 31 and 32.

Figure 2:
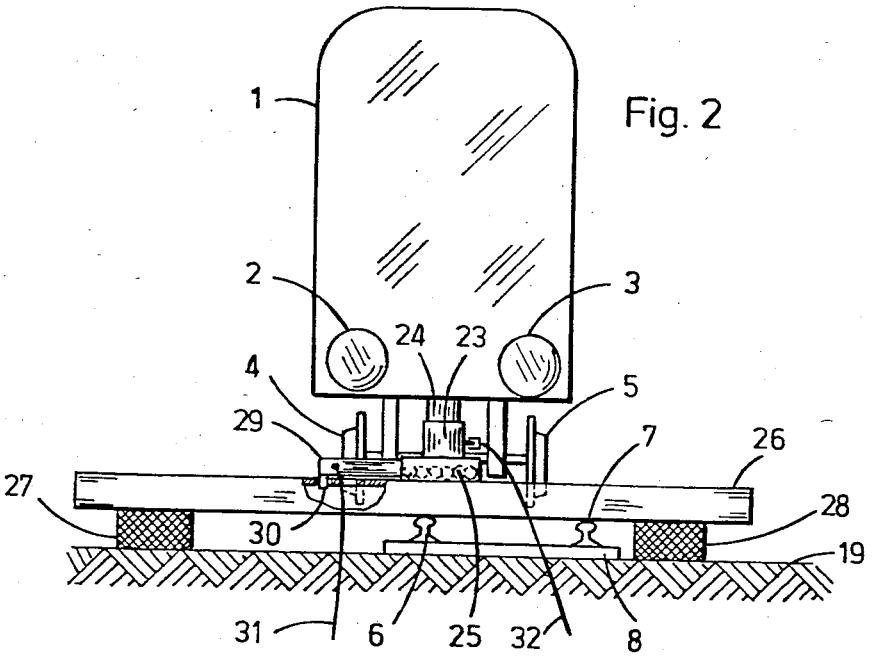
FIG. 2 shows a righted vehicle ready to be pushed onto a rerailing bridge over the corresponding track.

The final operation shown in FIG. 2 can be now understood. When the jack 23 is acted on by hydraulic pressure via the line 32, the vehicle 1 can be lifted upwards. Whem the cylinder 29 is acted on via the line 31, on the other hand, the vehicle 1 can be shifted in horizontal direction on the rerailing bridge 26 until the wheels 4 and 5 come to lie precisely above the corresponding rails 6 and 7. When this position has been reached, the vehicle can be let down by lowering the hydraulic pressure in the cylinder 23 and placed on the rails 6 and 7. Upon the further retraction of the piston 24 of the cylinder 23, the jack 23 can then be removed and the rerailing bridge 26 as well as the hardwood base supports 27 and 28 removed.

Figure 3:
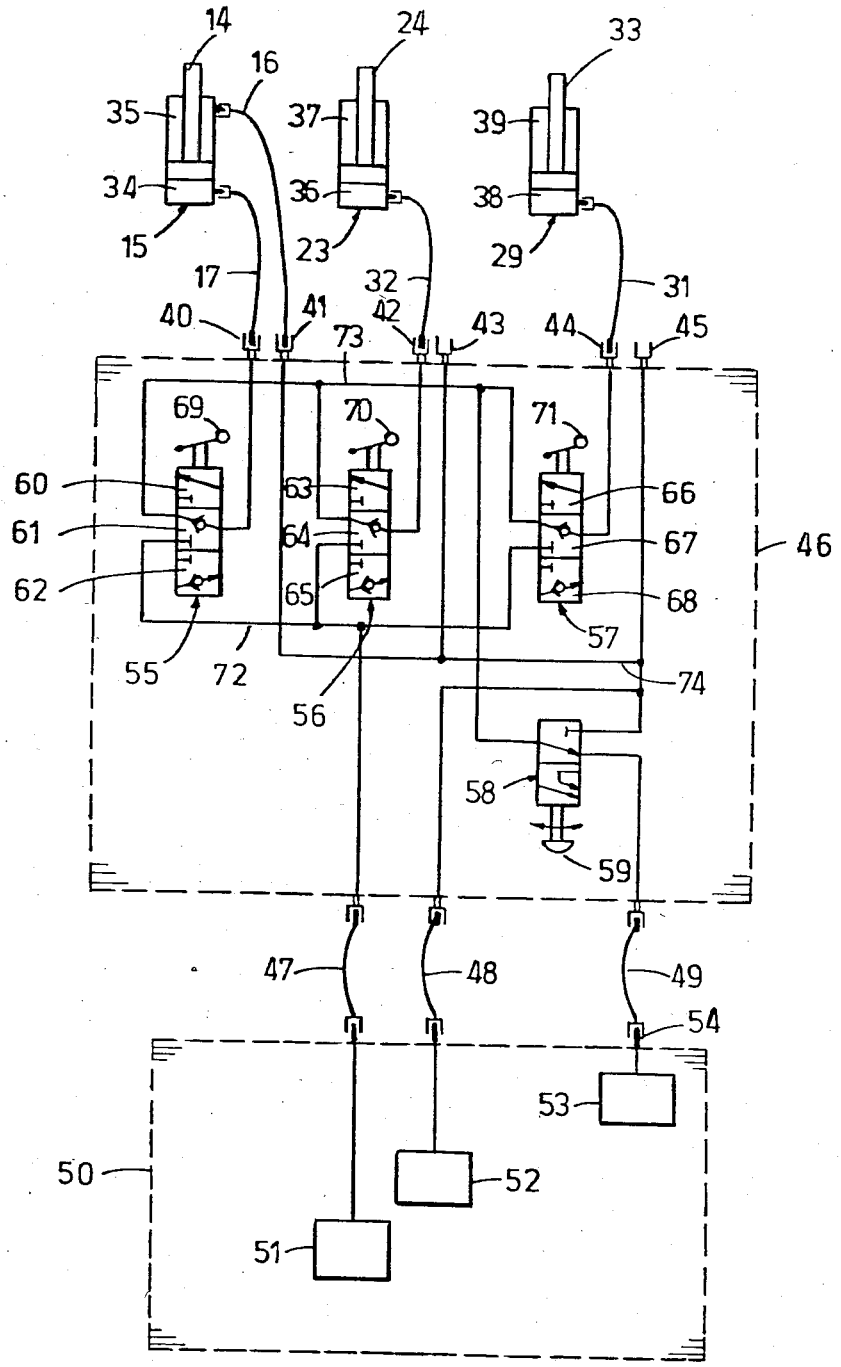
FIG. 3 shows the hydraulic connection of the parts shown in FIGS. 1 and 2.

The three hydraulic cylinders 15, 23 and 29 which perform the operation together with their corresponding hydraulic hoses 16, 17, 32 and 31, are shown in FIG. 3. The hydraulic cylinder 29 has the piston rod 33. The hydraulic cylinder 15 has the two hydraulic chambers 34 and 35, the hydraulic cylinder 23 has the hydraulic chambers 36 and 37, while the hydraulic cylinder 29 has the hydraulic chambers 38 and 39.

Said hydraulic hoses are connected to a control board 46 by means of plug-in type couplings 40, 41, 42, 43, 44 and 45. Said control board can be of any desired shape and is portable. It is connected via additional hydraulic hoses 47, 48, and 49 to an energy-producing unit 50. The latter is also portable and contains a high-pressure hydraulic producer 51, a low-pressure hydraulic producer 52 as well as a hydraulic-oil storage or collection container 53. The hydraulic hoses 47, 48, and 49 are also connected via plug-type connections—only the plug connection 54 is shown there for reasons of simplicity—to the control board 46 and the energy producing unit 50.

The control board 46 contains three three-way, three-position control valves 55, 56 and 57. Valve 58 is a means of connection to a vacuum producer. In the embodiment shown, this vacuum producer is a suction unit which can be switched with infinitely variable adjustment by the actuating member 59, namely from a position at which there is pure liquid passage to a position in which a vacuum is produced. The valve 55 has the function chambers 60, 61 and 62. The valve 56 has the function chambers 63, 64 and 65, while the valve 57 has the function chambers 66, 67 and 68. The valve 55 can be actuated via the operating lever 69, the valve 56 via the actuating lever 70 and the valve 57 via the actuating lever 71.

As can be noted from FIG. 3, the high-pressure hydraulic producer 51 is connected to a distribution line 72. Another distribution line 73 is connected to the vacuum-producer 58. A third distribution line 74 is connected, on the one hand, to the low-pressure hydraulic producer 52 and, on the other hand, to the hydraulic plug-type connections 41, 43 and 45. The hose 16 is inserted in the plug-type connection 41.

Upon the rerailing of a vehicle, the two hydraulic pressure producers 51 and 52 are permanently connected. Therefore, high hydraulic pressure is constantly present on the distributor line 72 while low hydraulic pressure is continuously present on the distributor line 74.

The manner of operation of the parts shown in FIG. 3 is as follows: Assume, first, that the piston 24 of the jack 23 is to be moved out. For this purpose, the operating lever 70 is pressed upwards. In this case, hydraulic oil from the distribution line 72 can pass, in accordance with the function symbol 65, and the hose 32 into the lower hydraulic chamber 36 of the hydraulic cylinder 23 and thereby force the piston 24 of that cylinder upwards. If, on the other hand, the piston 24 is to be moved downward under load, then the operating lever 70 is pressed downward to a greater or lesser extent. As a result, the function symbol 63 of the valve 54 enters into action and the hydraulic oil can flow via the hose 32 and the vacuum producer 58, which is still open for passage, as well as the hose 49 into the storage or collecting container 53.

If the piston rod 24 is not to be retracted without load, the operating lever 70 is pressed downward but at the same time switched to the production of vacuum by means of the rotary knob 59 of the vacuum producer 58. In this way, the distribution line 73 is also provided with vacuum. This vacuum then acts, via the hose 32, on the hydraulic chamber 36 of the working cylinder 23 and thus retracts the piston of this cylinder.

As mentioned above, the rapidity of this retraction of the piston, which is effected solely by vacuum, is greatly dependent on the temperature of the hydraulic oil. In very cold regions, the retraction of the piston can take place only very slowly. The plug connections 41, 43 and 45 are provided for such cases. In the following, reference will be had to the hydraulic cylinder 15. As can be seen, the hydraulic chamber 35 of this cylinder is connected via the hose 16 to the plug coupling 41. As can furthermore be seen, this plug coupling, as well as the plug couplings 43 and 45, are connected via the distributor line 74 to the low pressure producer 52. Accordingly, the low pressure of the latter acts continuously on the hydraulic chamber 35 of the cylinder 15. One might speak here of a "hydraulic spring." As a result, a continuous retraction pressure is exerted on the piston 14 of this cylinder. This has the result that, even in the case of very low temperatures, the retraction of the piston 14 takes place relatively rapidly. The pressure of the low-pressure hydraulic producer 52 is relatively slight; it amounts, for instance, to 20 to 50 bar. On the other hand, the high pressure of the high-pressure hydraulic producer 51 is substantially higher and amounts, for instance, to 450 bar. As a result, the moving out of the piston rod 14 under load, and therefore the righting of the vehicle (see FIG. 1), is scarcely affected by the retraction pressure which is constantly present.

As can easily be noted from FIG. 3, one and the same embodiment of the rerailing device of the invention can be manufactured and kept in stock for use when the temperature is low as well as high. Upon use at very low temperature, the hose 16 is also connected, while at relatively high temperatures, it is simply omitted.

The designs for rerailing railroad cars originally employed double-action operating cylinders. This required that two hydraulic lines were directed to each cylinder. In practical operation, this created a significant drawback because several operating cylinders must be employed as a rule. The situation as a whole was extremely difficult to monitor because of the large number of hose lines. Thus, the first step in the development of this control art was an arrangement in which only one hose per cylinder was necessary. This, among other things, was shown in German Pat. No. 1 098 978 wherein the piston for the cylinder returned by vacuum applied to the pressure connection. The device was placed in use by Frieseke and Hoepfner, a predecessor of the assignee of the present invention. Thus, the single hydraulic hose could be used both to erect the vehicle or push it on to the rerailing bridge when subjected to high pressure and to retract the piston with relatively slight vacuum after the initial push had been accomplished. Thus, only half the hose lines became necessary. This advance was so successful, that, despite the cost of maintaining German patents, this particular German patent was maintained until the last day.

In the course of time, it turned out that in locations having a very low temperature, the piston could be retracted by vacuum very slowly because the low temperature tended to stiffen the hydraulic oil. A substitute solution that was presented was the use of double-action hydraulic cylinders. This required, however, that it would be necessary to manufacture and warehouse two different types of rerailing equipment, one with vacuum piston return for warm climates and double-action cylinders for arctic climates. It was necessary to find a solution which would enjoy the advantages of both methods without the drawbacks of either.

The present invention uses as the point of departure rerailing equipment in which the return stroke of the piston was accomplished by vacuum alone. The vacuum was generated not only by the high pressure source for the operating stroke of the cylinder, but also by a low pressure source that governs a suction nozzle for generating vacuum for the piston return stroke. In the present invention, a universal operation could be obtained in a very simple way if the second operating space of a cylinder could be connected through a simple additional line to the existing source of low pressure. In cases where the ambient temperature was normal or when there was enough time available for the piston to return, the return stroke could be obtained by simply applying vacuum to the pressure space. In this case, only the relatively few pressure hose lines would be necessary. The same components could be utilized during periods of very low outside temperature to obtain a rapid return stroke. It would only be necessary to extend an additional hose line from the low pressure source to the second annular space in the same identical cylinder.

In addition to the return stroke generated by the vacuum applied to the pressure space, the piston was now subjected to a constantly active force in the return direction. The system of the present invention accordingly does not involve different cylinder drives, but is a wholly new method of operation comprising suction on one side and pressure on the side of the piston.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A hydraulic device applicable for use under temperature conditions which may vary unpredictably over the full range available in a particular climate for lifting and rerailing an overturned rail vehicle, comprising:

a rerailing bridge;

at least one hydraulic lift cylinder, adapted for lifting the overturned vehicle;

a roller carriage rolling along said rerailing bridge, this carriage being adapted for transporting the upright vehicle;

at least one traversing cylinder adapted for moving said roller carriage;

at least one of said cylinders having a piston therein which is displaceable along said cylinder; a pressure chamber in said cylinder at one side of the piston for being pressurized to bias the piston to be displaced to provide lift against the load; a second chamber in the cylinder at the other side of the piston;

a vacuum generator;

a hydraulic pressure generating unit, comprising a high pressure source with high pressure connection, and a first low pressure connection for feeding to the vacuum generator;

control valve means for selectively connecting the pressure chamber of the one cylinder with the high pressure connection for pressurizing the pressure chamber for biasing the piston for lifting a load and for selectively connecting the pressure chamber with the first low pressure connection for the vacuum generator to reduce pressure in the pressure chamber for moving back the piston when the piston is not under load;

a low pressure source with a second reduced pressure connection connected to the second chamber of the cylinder for pressurizing the second chamber for biasing the piston contrary to the bias exerted by pressurizing the pressure chamber and for cooperating with the vacuum generator for returning the piston when the piston is not loaded, said hydraulic structure being usable over a full range of climatic temperature variations.

2. The hydraulic lift device of claim 1, further comprising a second one of the hydraulic lift cylinders also having a pressure chamber and a second chamber, and the second reduced pressure connection being disconnected from the second chamber of the second cylinder, while the control valve means selectively connects one of the high pressure connection and the first low pressure connection to the pressure chamber of the second cylinder.

3. The hydraulic lift device of claim 1, further comprising a common low pressure source for feeding said vacuum generator and for cooperatively biasing said piston.

4. The hydraulic lift device of claim 1, further comprising a control table for receiving the control valve means and the table having valve operators thereat for operating the control valve means to the respective selective positions.

5. The hydraulic lift device of claim 2, further comprising a control table for receiving the control valve means and the table having valve operators thereat for operating the control valve means to the respective selective positions.

6. The hydraulic lift device of claim 3, further comprising a control table for receiving the control valve means and the table having valve operators thereat for operating the control valve means to the respective selective positions.

7. The hydraulic lift device of claim 6, wherein there are a plurality of the first-mentioned ones of the hydraulic lift cylinders, and each of the first lift cylinders being connected in the same manner to the high pressure connection, to the second low pressure connection and to the vacuum generator.

8. The hydraulic lift device of claim 7, further comprising a plurality of further withdrawal connections connected to the second reduced pressure connection and each of the further withdrawal connections being connectable to a respective one of the second chambers of the first hydraulic cylinders.

9. The hydraulic lift device of claim 8, wherein the further withdrawal connections are on the control table.

10. The hydraulic lift device of claim 2, further comprising at least one withdrawal connection being connectable to the second chamber of said cylinder and a low pressure source.

11. The hydraulic lift device of claim 10, further comprising a control table for receiving the control valve means, said table having valve operation thereat for operating the valve means wherein the further withdrawal connections are on the control table.

* * * * *